United States Patent [19]

Keefe

[11] Patent Number: 5,012,994

[45] Date of Patent: May 7, 1991

[54] VARIABLE WIDTH BAG HOLDER

[76] Inventor: Richard Keefe, 3515 Illinois Rd., Wilmette, Ill. 60091

[21] Appl. No.: 341,825

[22] Filed: Apr. 24, 1989

[51] Int. Cl.[5] ..... B65B 67/04

[52] U.S. Cl. ..... 248/558; 248/99; 248/302

[58] Field of Search ..... 248/558, 95, 97, 99, 248/100, 101, 150, 153, 175, 289.1, 302, 149; 141/314, 390, 391; 220/1 T, 404

[56] References Cited

U.S. PATENT DOCUMENTS

| | | | |
|---|---|---|---|
| 447,686 | 3/1891 | Holladay . | |
| 461,291 | 10/1891 | Timmerman . | |
| 2,470,890 | 5/1949 | Goodpasture | 248/302 |
| 3,638,888 | 2/1972 | Ross | 248/153 |
| 4,062,170 | 12/1977 | Orem . | |
| 4,332,361 | 6/1982 | McClellan . | |
| 4,398,689 | 8/1983 | Prader . | |
| 4,407,474 | 10/1983 | Swenson . | |
| 4,458,867 | 7/1984 | Malik . | |
| 4,461,441 | 7/1984 | Briggs . | |
| 4,487,388 | 11/1984 | Provan . | |
| 4,498,652 | 2/1985 | Malik | 248/99 |
| 4,579,307 | 4/1986 | Malik . | |
| 4,669,689 | 6/1987 | Jones . | |
| 4,695,020 | 9/1987 | Collins . | |
| 4,750,695 | 6/1988 | Greenhouse | 248/99 |
| 4,838,504 | 6/1989 | Bittenbinder | 248/100 |
| 4,840,335 | 6/1989 | Forman, Jr. | 248/97 |

FOREIGN PATENT DOCUMENTS

| | | | |
|---|---|---|---|
| 221765 | 5/1910 | Fed. Rep. of Germany | 248/99 |

*Primary Examiner*—Alvin C. Chin-Shue
*Assistant Examiner*—Robert A. Olson
*Attorney, Agent, or Firm*—John G. Tolomei

[57] ABSTRACT

A bag holder support system for disposable, loop handled plastic bags provides dual position mounting so that the system can be easily installed in one position to fit in restricted areas and installed in a different position to provide a maximum opening for the bag when installed in an unrestricted area. The support system includes a pair of brackets that hold the plastic bag open by its oppositely disposed integral handle loops so that the bag may be loaded. The brackets are made of a closed wire loop that forms a planar arm having an upwardly extending U-shaped lug in the center of a horizontally extending member for engaging one of said handle loops. Means are provided for mounting each arm to a vertical surface by a vertical side of the arm that the arm extends in a horizontal direction and lies in a vertical plane. An arm positioning ear formed by the wire loop extends out of the plane of said arm at a non-perpendicular angle so that the arms converge or diverge as they extend away from the vertical surface. This dual position mounting provides a simple bag support system that is equally suited and readily installed on a cabinet door under a sink or on an open wall area. The system can also include a flat support panel that pivotally supports the arms. The support panel spaces the arms apart and can be mounted to a vertical surface in a first position so that the arms converge as they extend away from the vertical surface and in a second position so that they diverge as they extend away from the vertical surface.

15 Claims, 3 Drawing Sheets

VARIABLE WIDTH BAG HOLDER

FIELD OF THE INVENTION

This invention relates generally to devices for holding plastic bags open for loading where bags are the type having integral carrying or handle loops . More specifically this invention relates to light weight, wall-mounted devices for reusing integral loop handled plastic bags for the storing and disposal of refuse.

BACKGROUND OF THE INVENTION

The use of plastic bags having integral loop handles is steadily supplanting the use of paper bags in commercial establishments. The desirability of reusing these bags for home refuse has been recognized in the prior art. A number of plastic bag holders are available for home use. However, none of these bag holders appear to be widely accepted by consumers.

In order to be successful in home use a plastic bag holder must meet a number of criteria. First the bag holder must be low priced. In addition it must be compact when packaged so that it will not take up excessive shelf space and retailers will be willing to stock it. The bag holder must also be suitable for simple installation into a variety of different locations within a home. For example it must be suitable for installation on cabinet doors under a kitchen sink or in a narrow space against a wall as well as in open areas where space is not restricted. However, none of the commercially or domestically available bag holders offers a low cost design together with simplicity, versatility, and the ability to be compactly packaged.

U.S. Pat. No. 4,695,020 issued to Collins and U.S. Pat. No. 4,669,689 issued to Jones show light weight plastic bag holders that can be manufactured from sheets of plastic stock. In both of these references the bag holders have arms that extend perpendicularly to the mounting surface and are therefore unsuitable for use under kitchen cabinets or in narrow wall areas.

U.S. Pat. No. 4,458,867 issued to Malik, U.S. Pat. No. 4,487,388 issued to Provan, U.S. Pat. No. 4,062,170 issued to Orem, and U.S. Pat. No. 4,407,474 issued to Swenson teach bag holders for commercial use that are constructed of wire or solid sided members. Again the arms on all of these plastic bag holders make them unsuitable for a variety of installations. In addition, aside from being expensive, these bag holders have a rigid construction and occupy a large volume, as a result they are impractical for the home retail market.

U.S. Pat. No. 4,332,361 issued to McClellan shows a relatively simple bag holder system that consists of two independent arms that are mounted to a vertical surface. However, McClellan only describes and illustrates a perpendicular mounting of the arms relative to the vertical surface.

Bag holders having pivotable arms are well known in the prior art. U.S. Pat. No. 461,291 shows a holder for canvas type bags that uses a complex detente system to adjust the angle at which the arms extend.

A number of other bag holder systems have foldable arms that allow the holders to be compactly shipped or stored. This type of bag holder is shown in U.S. Pat. No. 4,461,441 issued to Briggs, U.S. Pat. No. 4,579,307 issued to Malik, U.S. Pat. No. 4,398,689 issued to Prader, and U.S. Pat. No. 447,686 issued to Holladay. All of these bag holders are arranged such that the arms may be folded from a perpendicularly extending position to a position wherein the arms are essentially parallel to the back support.

SUMMARY OF THE INVENTION

Applicant has discovered a simple bag holder support system, specially suited for the home market, that can be easily mounted on a vertical surface in a position that provides a narrow opening or a position that provides a large opening. This dual position mounting capability makes a single bag holder suitable for mounting on a cabinet door where space is restricted or on an open wall surface where a large surface is available and a large bag opening is desired. More importantly, this dual mounting capability is provided simply and cheaply by the use a simple mounting ear at the back of each bracket in a pair of support brackets.

Therefore in its simplest form this invention consists of a bag holder support bracket for use in pairs to hold a plastic bag open by its oppositely disposed integral handle loops so that the bag may be held open for loading. The bracket is in the form of a planar arm. A means for mounting the bracket to a vertical surface by one side of the arm is also included. The means for mounting positions the arm such that it extends in a horizontal direction and lies in a vertical plane. In order to hold the handle loop of the bag a handle lug extends horizontally along and upwardly from each arm. An arm positioning ear is fixed to each arm and extends out of the plane of the arm at a non-perpendicular angle so that when mounted on a vertical surface the arm forms a non-perpendicular angle with the vertical mounting surface.

In a more limited embodiment this invention comprises a bag holder support system for holding a plastic bag open by its oppositely disposed integral handle loops so that the bag may be held open for loading that includes a pair of planar arms each of the arms having an upwardly extending U-shaped lug in the center of a horizontally extending member for engaging one of the handle loops and an arm positioning ear fixed to and extending out of the plane of the arm at a non-perpendicular angle. The arms are attached to an elongate mounting panel that has means for pivotally holding a vertical side of each of the planar arms in a spaced apart relationship such that each of the arms extend horizontally and lie within a vertical plane. Means for mounting the support system to a vertical surface are also included.

Other aspects of this invention include particular arrangements and constructions for the brackets ears and panel. These aspects along with specific details of the invention are more fully described in the following detailed description of the invention.

DETAILED DESCRIPTION OF THE INVENTION

Figure 1:
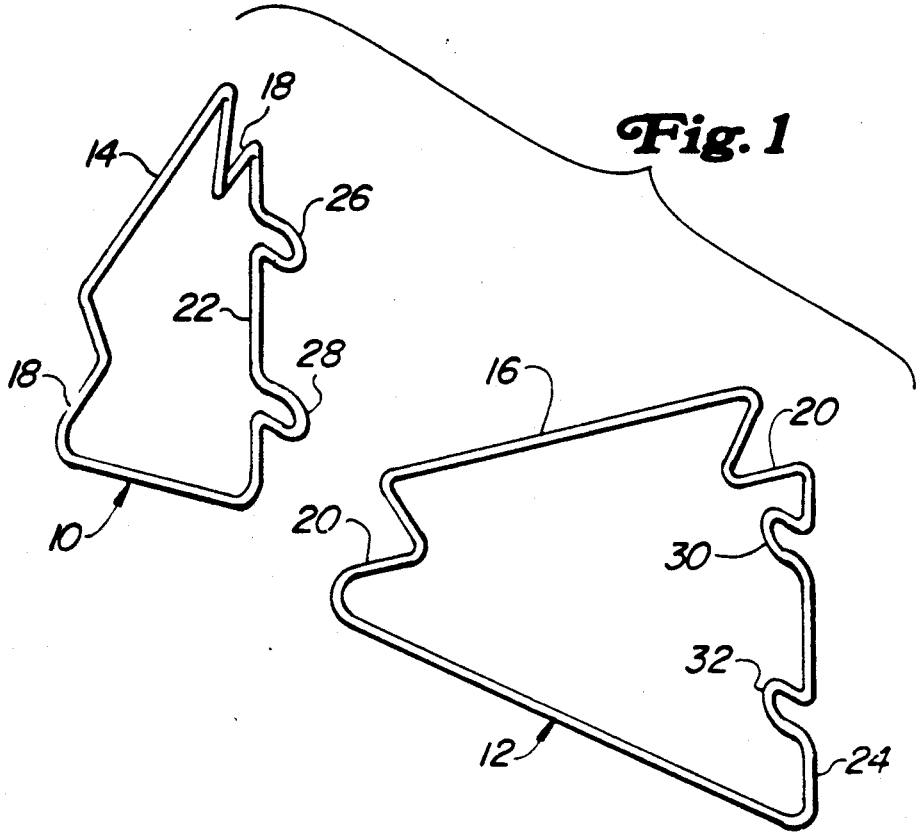
FIG. 1 shows a pair of brackets mounted in an outwardly converging relationship by the ear of this invention.

The support system of this invention in its simplest form can consist of a pair of spaced apart mounting brackets having at least one ear that extends from the bracket at angle that is not parallel or perpendicular to the bracket. FIG. 1 shows the brackets in the form of a left arm 10 and a right arm 12. Arms 10 and 12 in FIG. 1 are formed by bending and welding a single wire; however the arms may be formed by any suitable method from a variety of materials including multiple wires or solid material. For simplicity the arms are generally planar. Nevertheless arms that are gently curved or bowed can also work well and are not meant to be excluded from the scope of this invention.

Opposite handle loops of the plastic bag (not shown) are supported form the top of the arms. For this purpose arms 10 and 12 have U-shaped lugs 14, 16 that extend upwardly from horizontal wire segments 18, 20. Wire segments 18 and 20 form a ledge on opposite sides of the lugs that vertically support the handle loops. It is desirable to provide lugs 14 and 16 with a relatively long horizontal width so that the handle loops of the bag are fully extended. Providing a relatively long width to lugs 14 and 16 maximizes the bag opening and prevents sagging of the bag as it is filled.

The back of each of the arms in FIG. 1 is mounted at the same elevation to a vertical surface. A vertical side 22, 24 at the back of each arm provides part of the means for mounting each arm. Arms 10 and 12 have ears 26, 28 and 30, 32 respectively that project horizontally outward from vertical sides 22, 24. The ears in the embodiment of FIG. 1 have the advantage of also providing a part of the means for mounting each bracket; however, it is not necessary for the practice of this invention that the ears provide this function. In fact, oppositely orientated ears can be used on the support side of each arm to provide the same positioning function without any external attachment to the ears. The looped configuration of the ears in this embodiment provides a convenient structure for holding fasteners that secure the arms to a vertical surface such as a wall or cabinet door. The function of the ears and their orientation with respect to the arms can be more readily understood from FIG. 2.

Figure 2:
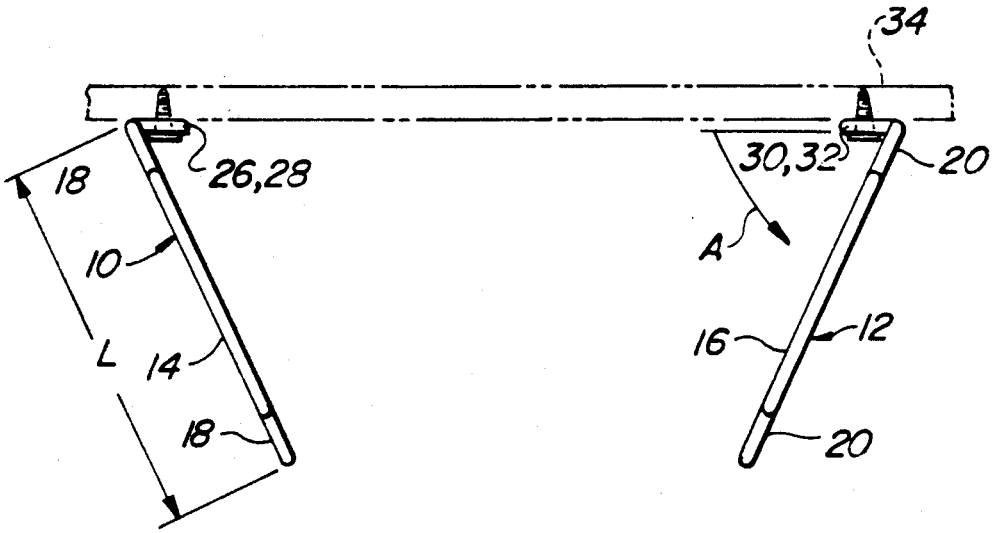
FIG. 2 shows a plan view of FIG. 1.

In FIG. 2 a set of fasteners 32 secure arms 10 and 12 in an outwardly converging arrangement by passing through ears 26, 28, 30 and 32 and into a vertical surface 34. Contact of the ears with the vertical surface 34 causes each arm to have a non-perpendicular angle with respect to vertical surface 34. In FIG. 2 the arms are mounted such that the arms converge i.e. the space between the arms is smallest at the outer ends of the arms. This arrangement is particularly suited for installation on a cabinet door under a sink where the relatively long extended arms must converge in order to permit the cabinet door to be opened and closed. Although reducing the length of arms that extend perpendicularly from a cabinet door will also provide the necessary clearance, this approach can result in the previously described disadvantages of reducing the opening size and causing the bag to sag as it is loaded. By this invention the arms 10 and 12 can be kept long to fully engage the handle loops of the bag and more fully support the bag. For most bags arms 10 and 12 will have a length L of about eight to ten inches. When door clearance is not a problem the system can be mounted so that the arms diverge by putting arm 12 in the left position and arm 10 in the right position. This is useful when the system is installed against an open wall since this arrangement provides as a large an opening as possible. This maximum size opening is not necessary when the holder is installed under a cabinet since the person disposing of the trash is usually in close proximity when dropping refuse into the bag. The opening size and position of the arm is determined by the angle A that the ear makes with the arm and may be adjusted to suit the particular needs of the user. Typically this angle will be in a range of from 20 to 45 degrees with an angle of about 30 degrees being particularly preferred.

Figure 3:
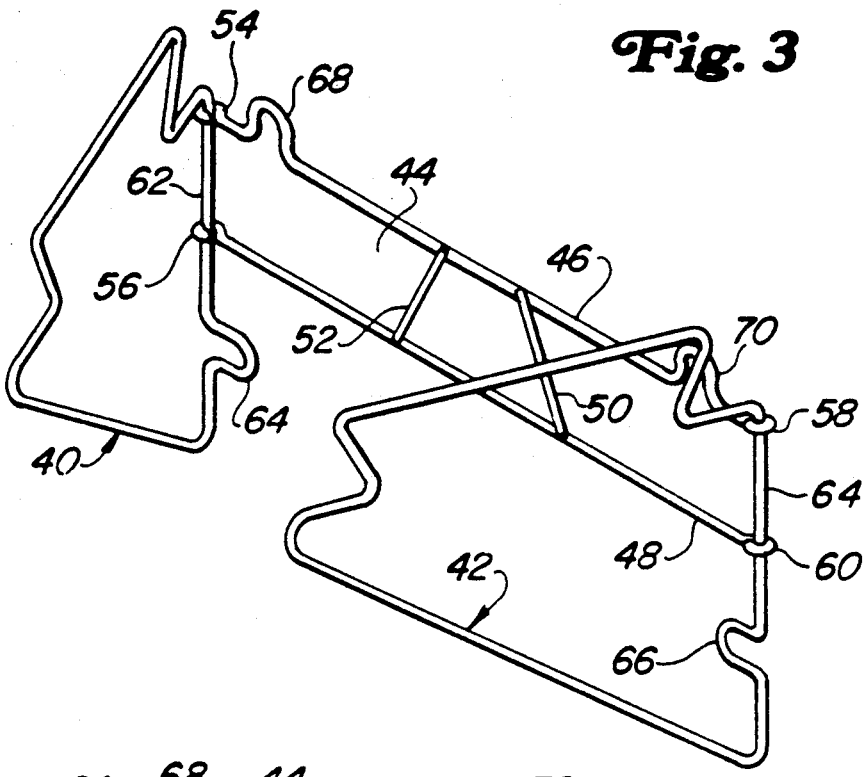
FIG. 3 shows a pair of arms having ears in accordance with this invention and a mounting panel joining the arms.

A more complete bag support system is shown in FIG. 3 where a pair of brackets in the form of planar arms 40, 42 are joined by a support panel 44. Support panel 44 spaces the brackets apart and can also provide at least part of the means for supporting the brackets. The panel 44, like the brackets, can be fabricated in a variety of ways from a variety of different materials. FIG. 3 shows the panel formed by an upper wire 46 and a lower wire 48 which are spaced apart by connecting wires 50 and 52. An ear 68, 70 is formed by small loops in upper wire 46 about opposite ends of panel 44. A fastener is placed through ears 68 and 70 to support panel 44. At opposite ends of panel 44 each wire provides a an upper loop 54, 58 and a lower loop 56, 60 that surround vertical wires 62 and 64 to pivotally support arms 40 and 42. Arms 40 and 42 are similar in arrangement to arms 10 and 12 of FIGS. 1 and 2. However, unlike the arms 10 and 12, arms 40 and 42 have a single ear 64, 66 located in a lower portion of vertical wire 62, 64. Appropriate fasteners are placed through the loops of ears 64 and 66 so that they support the lower end of arms 40 and 42 and hold the arms in an angled position.

Figure 4:
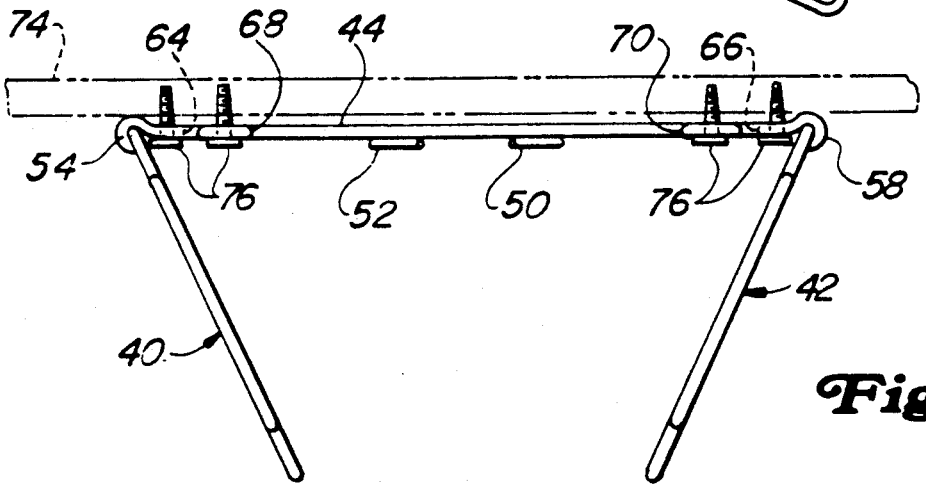
FIG. 4 is plan view of FIG. 3 showing the arms mounted in an outwardly converging relationship.
Figure 5:
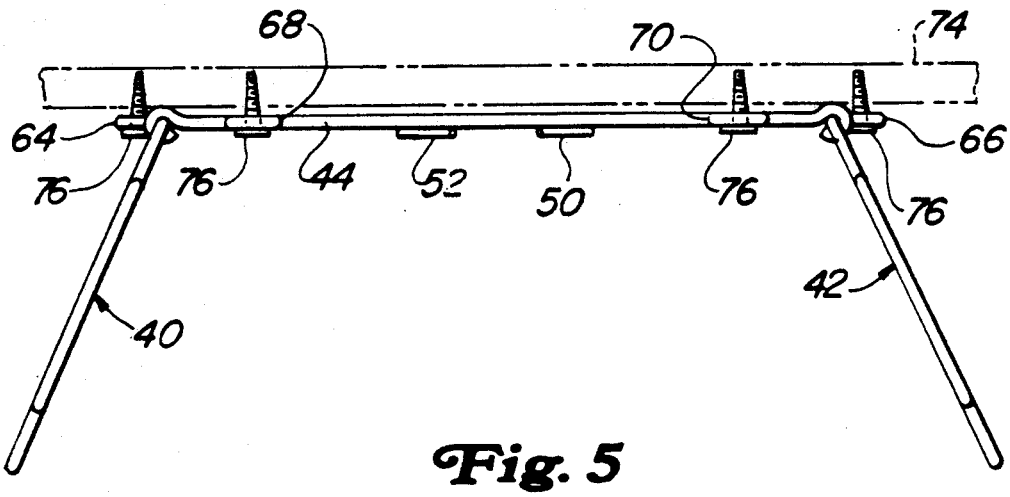
FIG. 5 is a modified plan view of FIG. 3 showing the arms in an outwardly diverging relationship.

The support system of FIG. 3 is arranged so that it may be installed with the arms in a diverging or converging arrangement. Panel 44 is essentially flat so that it has a planar arrangement with a front side and a back side. Either the front side or the back side may be mounted against a vertical surface. The system of FIG. 3 is arranged with ears 64 and 66 making an acute angle with respect to arms 40 and 42. When, as shown in FIG. 4, the back side 72 of panel 44 is secured to a vertical surface 74 by fasteners 76 the ears 64, 66 extend inwardly with respect to the system and the arms 40, 42 converge as they extend outward i.e. away from vertical surface 74. By reversing the mounting of the system, as shown in FIG. 5, so that the front side 78 of panel 44 is mounted against surface 74 ears 64, 66 extend outwardly with respect to the system and arms 40 and 42 diverge as they extend outward. Thus, the support system shown in FIG. 3 provides a complete and simple bag support system with a dual mounting capability.

Figure 6:
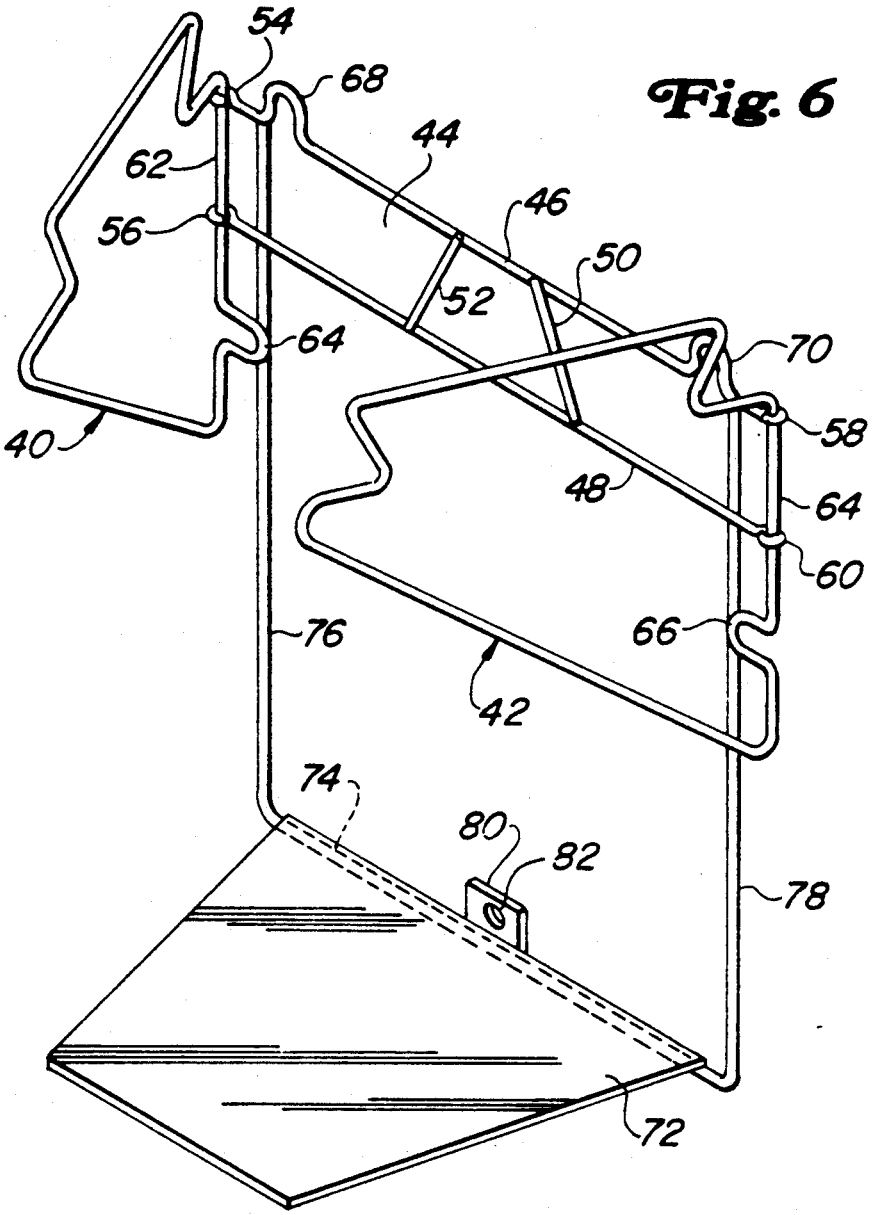
FIG. 6 is a modified view of FIG. 3 showing the addition of a bottom bag support plate and members.

In another embodiment of this invention the support system includes a support for holding up bottom of the bag. FIG. 6 shows a bottom support plate 72 that extends outwardly from the vertical surface to provide a shelf for the bottom of the bag. A U-shaped wire, having a horizontal wire section 74 and vertical wire sections 76 and 78, positions plate 72 at the bottom of the support system. Wire sections 76 and 78 are attached to wires 46 and 48. Plate 72 is pivotally mounted on wire section 74 and may be flipped to extend horizontally outward from either side of the support system. Any suitable means can be used to hold the plate 72 in a horizontal position such as stops on wire section 74 or links to arms 40 and 42. In FIG. 6 a lug 80 extends perpendicularly from plate 72 to provide means for securing the plate in a horizontal position by the insertion of a fastener through hole 82 and the attachment of the fastener to the vertical surface. Plate 72 is sized to fit in the space between wire 48 and wire sections 74, 76 and 78 so that the support system can be folded flat for packaging.

What is claimed is:

1. A bag holder support system for holding a plastic bag open by its oppositely disposed integral handle loops so that the bag may be held open for loading, said system comprising, a pair of planar arms each of said arms having an upwardly extending U-shaped lug in the center of a horizontally extending member for engaging one of said handle loops, a vertical side from which said arm is supported and an arm positioning ear fixed to said vertical side and extending out from said arm at a non-perpendicular angle;

an elongate mounting panel having means for pivotally holding said vertical side of each of said arms in a spaced apart relationship such that each of said arms extend horizontally and lie within a vertical plane; and means for mounting said support system to a vertical surface.

2. The system of claim 1 wherein said mounting panel is formed from a wire, said means for pivotally holding comprise at least two wire loops formed at opposite ends of said panel and said means for mounting said support system includes at least one upper ear formed about each end of said panel and adapted for engaging fasteners therein.

3. The support system of claim 1 wherein said arms outwardly converge as they horizontally extend when said ears are fixed to said vertical surface.

4. The support system of claim 3 wherein each of said arms has at least one ear such that when fixed together with the corresponding ear in the other of said arms to said vertical surface said arms will outwardly converge as they extend horizontally and each of said arms has at least one ear such that when fixed together with the corresponding ear in the other of said arms to said vertical surface said arms will diverge as they extend horizontally.

5. The support system of claim 4 wherein each of said arms has one ear.

6. The support system of claim 5 wherein said panel is flat such that said panel has a front side and a back side and said vertical side of each of said planar arms lies in the plane of said panel such that said support system may be mounted with said front side or said back side in contact with said vertical surface.

7. The bag holder support system for holding a plastic bag open by its oppositely disposed integral handle loops so that the bag may be held open for loading, said system comprising, a pair of planar arms each formed by a closed wire loop, each of said arms having an upwardly extending U-shaped lug in the center of a horizontally extending member for engaging one of said handle loops, a vertical side of said wire from which said arm is supported, and an arm positioning ear formed by said wire loop in said vertical side and extending out of the plane of said arm at a non-perpendicular angle;

an elongate mounting panel having means for pivotally holding said vertical side of said wire at one end of each of said planar arms in a spaced apart relationship such that each of said arms extend horizontally and lie within a vertical plane; and means for mounting said support system to a vertical surface.

8. The system of claim 7 wherein said mounting panel is formed from a wire, said means for pivotally holding comprise at least two wire loops formed at opposite ends of said mounting panel and said means for mounting said support system includes at least one upper ear formed about each end of said mounting panel and adapted for engaging fasteners therein.

9. The support system of claim 8 wherein said arms outwardly converge as they horizontally extend when said upper ears are fixed to said vertical surface.

10. The support system of claim 9 wherein each of said arms has one ear such that when fixed together with the corresponding ear in the other of said arms to said vertical surface in a first position said arms will outwardly converge as they extend horizontally extend and when fixed together with the corresponding ear in the other of said arms to said vertical surface in a second position said arms will diverge as they horizontally extend.

11. The support system of claim 10 wherein said panel is flat such that said panel has a front side and a back side and said vertical portion of wire in each of said planar arms lies in the plane of said panel such that said support system may be mounted with said front side or said back side in contact with said vertical surface.

12. A bag holder support system for holding a plastic bag open by its oppositely disposed integral handle loops so that the bag may be held open for loading, said system comprising, a pair of planar arms each of said arms having an upwardly extending U-shaped lug in the center of a horizontally extending member for engaging one of said handle loops, a vertical side from which said arm is supported and an arm positioning ear fixed to said vertical side and extending out from said arm at a non-perpendicular angle;

an elongate mounting panel having means for pivotally holding said vertical side of each of said arms in a spaced apart relationship such that each of said arms extend horizontally and lie within a vertical plane;

means for mounting said support system to a vertical surface;

a bottom support member positioned below said U-shaped lugs; and, means for holding said support member such that said support member extends horizontally and lies within a horizontal plane.

13. The bag holder support system of claim 12 wherein said support member comprises a flat plate and said flat plate is pivotably mounted to the center section of a U-shaped wire.

14. The bag holder support system of claim 13 wherein said U-shaped wire is attached to said mounting panel and said center section of said U-shaped wire is positioned below said arms.

15. The bag holder support system of claim 14 wherein said flat plate has a perpendicularly extending lug that at least partially provides said means for holding said support member.

* * * * *